US005622039A

United States Patent [19]

Thompson

[11] Patent Number: 5,622,039

[45] Date of Patent: Apr. 22, 1997

[54] APPARATUS AND METHOD FOR THE MANUFACTURE OF UNIFORM IMPEDANCE COMMUNICATIONS CABLES FOR HIGH FREQUENCY USE

[75] Inventor: Walter Thompson, Toronto, Canada

[73] Assignee: Ceeco Machinery Manufacturing Limited, Concord, Canada

[21] Appl. No.: 434,021

[22] Filed: Jun. 9, 1995

Related U.S. Application Data

[63] Continuation-in-part of Ser. No. 225,852, Apr. 8, 1994.

[51] Int. Cl.[6] ..... D02G 3/36; D01H 7/90

[52] U.S. Cl. ..... 57/3; 57/6; 57/58.49; 57/58.52; 57/58.54; 57/58.83

[58] Field of Search ..... 57/3, 6, 31, 58.49, 57/58.52, 58.54, 58.55, 58.78, 58.83

[56] References Cited

U.S. PATENT DOCUMENTS

| | | | |
|---|---|---|---|
| 3,824,775 | 7/1974 | Birch | 57/58.52 |
| 3,921,378 | 11/1975 | Spicer et al. | 57/6 X |
| 4,385,485 | 5/1983 | Yonechi | 57/6 X |
| 4,574,574 | 3/1986 | Knaak | 57/58.54 X |
| 4,604,862 | 8/1986 | McGettigan et al. | 57/58.55 X |
| 4,628,675 | 12/1986 | Sakamoto | 57/3 |
| 4,896,494 | 1/1990 | Cholley | 57/3 X |

FOREIGN PATENT DOCUMENTS

| | | | |
|---|---|---|---|
| 240956 | 10/1987 | European Pat. Off. | 57/58.49 |
| 1414136 | 11/1975 | United Kingdom | 57/6 |
| 94/24349 | 10/1994 | WIPO | 57/58.52 |

*Primary Examiner*—William Stryjewski

*Attorney, Agent, or Firm*—Lackenbach Siegel Marzullo Aronson & Greenspan, PC

[57] ABSTRACT

Machine for manufacturing uniform impedance communication cables for high frequency use includes a series of staggered double twisting units or heads each of which supports two reels wound with single wire elements or conductors, and a constant tension tape dispenser. The wire elements from the reels as well as the tape from the tape dispenser are simultaneously unwound and guided to the ends of the rotating bows of the twisting units at which points the individual wire elements or conductors are twisted about each other and the tape is applied to the twisted wire pair to fix and maintain the spatial integrity of the twisted wires relative to each other. Each twisting unit rotated at slightly different speeds to assure different lay lengths for each twisted pair. The twisted pairs are guided downstream by a capstan and all of the twisted and taped wire sets are secured to each other by a pre-twisting and taping operation before the composite cable is wound onto a rotating take-up unit. A number of different design modifications are described for producing both simple and complex cable constructions which include twisted pairs, triads and quads.

2 Claims, 5 Drawing Sheets

APPARATUS AND METHOD FOR THE MANUFACTURE OF UNIFORM IMPEDANCE COMMUNICATIONS CABLES FOR HIGH FREQUENCY USE

CROSS REFERENCE TO RELATED APPLICATION

This application is a continuation-in-art of application Ser. No. 08/225,852 filed on Apr. 8, 1994.

BACKGROUND OF THE INVENTION

1. Field of the Invention

The invention generally relates to an apparatus and method for the manufacture of high quality communication cables of the type including a single or a plurality of sets of twisted wires.

2. Description of the Prior Art

Communication cables of the type which include a plurality of twisted wires are manufactured in either one stage or in two stages.

In the case where cables are manufactured in two stages, the twisted wires are firstly prepared by twisting the wires together by means of so-called twinning or pairing machines. Twisted wires are then made up into communication cables by means of, for example, stationary take-ups, rotating take-ups (also called drum twisting machines) or other type of rotating equipment.

One form of equipment conventionally used for twisting 2, 3 or 4 wires is the double twist machines. The resulting twisted elements are called pairs, triads or quads.

This equipment includes a bobbin cradle around which is arranged a rotatable frame or bow which is driven to turn around the cradle. Wires to be twisted may be supplied from bobbins on the bobbin cradle inside the twisting cage and taken up on a take-up reel outside the twinning cage. The aforementioned arrangement is referred to as an "inside-out" machine. The wires to be twisted may also be supplied from outside the twisting cage and taken up on a bobbin arranged within the bobbin cradle. The latter configuration is sometimes referred to as "an outside-in machine."

Outside-in machines are generally preferred in individual twisting machines since the wire may be supplied from storage facilities of simple construction and greater capacity. In this case, the bobbin cradle within the twisting cage is also required to hold only a single bobbin. The outside-in machine is also readily adaptable for use with a greater number of wires.

If communication cables are made in one stage, the apparatus generally employs a plurality of twisting machines, or heads of the "inside-out" type.

The twisted elements so manufactured are directed to any type of take-up (e.g. stationary or rotating take-ups, single or double twist machines, capstan or extrusion lines) for laying up twisted wires to form a communication cable. This is done in one operation.

The plurality of double twist twisting machines can be arranged horizontally or vertically, depending on the preferred plant layout.

One typical example of such an installation is disclosed in U.S. patent application Ser. No. 08/163,735 assigned to the assignee of the subject application.

It is well-known in the art that the lay obtained with double twist actions is not perfectly regular and if longer lays are used, in order to achieve higher speed of manufacture, some irregularity in the position of the cores in the twisted elements have to be accepted.

These irregularities in the lays do not cause problems in communication cables such as low frequency telephone cables used in standard telephone applications since the perfect constancy of the lays and in the relative position of the individual wires in each element (pair, triad or quad) are not that important.

With the advent of high speed data transmission, especially for computer use and other applications, the frequencies required are much higher and therefore standard pairs, triads or quads acceptable in telephone networks cannot be used in such high frequency applications.

In order to produce pairs, triads or quads that can operate satisfactorily at these frequencies, it is necessary to produce a cable in which the elements of each pair, triad or quad are maintained in the same desired position relative to each other so that the electrical characteristics of the pair, triad or quad do not vary along the length of the cable.

It is well-known, for example, that the characteristic impedance of an n-wire line is a function not only of the diameters of the individual conductors but also a function of the spacing or distances between the conductors. Matched impedances are critical at high frequencies to optimize power transfer, reduce line reflections which cause deterioration of signal integrity and optimize the useful frequency for which the cable can be used.

It has been proven that for example, the characteristic impedance of pairs can change drastically at different frequencies around its theoretical average. Cables utilizing high quality pairs have been produced for use in communication local area networks with a maximum useful frequency of 100 MHz. This, in the industry, is called a Level or Category 5 cable. The specification for these cables requires, for example, that the theoretical characteristic impedance of 100 Ohms can only vary between 85 and 115 Ohms from Zero to 100 MHz.

This can only be achieved by assuring that the relative position of each element is maintained throughout the length of the cable. The acceptable way of achieving this has been to shorten the lays of the elements in order to manufacture a mechanically more stable element. This approach has naturally reduced the productivity of the equipment used since there are physical limitations to the rotational speed of the bows used in the double twist machines.

The industry is already requiring twisted elements, especially pairs, that will maintain their electrical characteristics up to 350 MHz; this is normally called a Level or Category 6 communication cable.

SUMMARY OF THE INVENTION

It is an object of the present invention to provide an apparatus for making communication cables which does not have the disadvantages and limitations inherent in comparable prior art machines.

It is another object of the present invention to provide an apparatus of the type aforementioned which is simple in construction in inexpensive to manufacture.

It is another object of the present invention to provide an apparatus to manufacture communication cable which can operate at significantly higher linear speeds than comparable machines currently being used for making the same communication cable product.

It is a further object of the present invention to provide an apparatus for making telephone cables which makes it possible to produce pairs, triads or quads with the same machines used in conjunction with the invention covered in the aforementioned U.S. patent application Ser. No. 08/163,735.

It is still an additional object of the invention to provide a method for efficient production of communication cable.

In order to achieve the above objectives and others which will become apparent hereafter, an apparatus for making communication cables in accordance with the present invention comprises a frame and rotating means for rotation around an axis relative to said frame. A cradle is mounted on said frame and determined and configurated to be contained within an envelope defined by said rotating means and adapted to receive either two reels, each one wound with single wires, or a single reel wound with a set of at least two separate or connected wires which can be simultaneously unwound from the reel. It can also be adapted to receive four reels which have been wound with single or connected wires.

Guide means guide the wires from said reel or reels on said stationary cradle to said rotating means and therefore to said stationary frame thereby imparting at least one twist to the said at least two wires unwound from the two reels or from one reel (wound with two separate or connected wires).

Single and double twist machines can supply said twisting means to practice the invention.

On the same cradle a tape dispensing device is advantageously mounted so that a tape with suitable dimensions and characteristics can be fed together with at least two wires coming from the reel or reels to the closing point on the cradle. Therefore the tape and at least two wires are twisted while the two wires and the tape pass through the rotating means.

The method in accordance with the invention comprises the steps of simultaneously unwinding both a set of at least two wires wound on as few as a single reel and a tape from the tape dispensing apparatus.

The wires and the tape are guided to a twisting station and impart at least a single twist. In this manner a set of taped, twisted wires can be produced. The same process can be used to unwind single wires from at least two reels and the tape from the tape dispensing apparatus.

For more complex cables, the steps of the method are repeated in each twisting machine of a bank of twisting machines arranged in tandem to each other. The method further comprises the step of taking up the taped, twisted wires from all of the twisting machines at a point downstream from all such machines to form a composite cable.

BRIEF DESCRIPTION OF THE DRAWINGS

Other aspects, objects and advantages of the present invention will become apparent upon reading of the following detailed description of the preferred embodiment of the present invention when taken in conjunction with the drawings, as follows.

DESCRIPTION OF THE PREFERRED EMBODIMENTS

Figure 1:
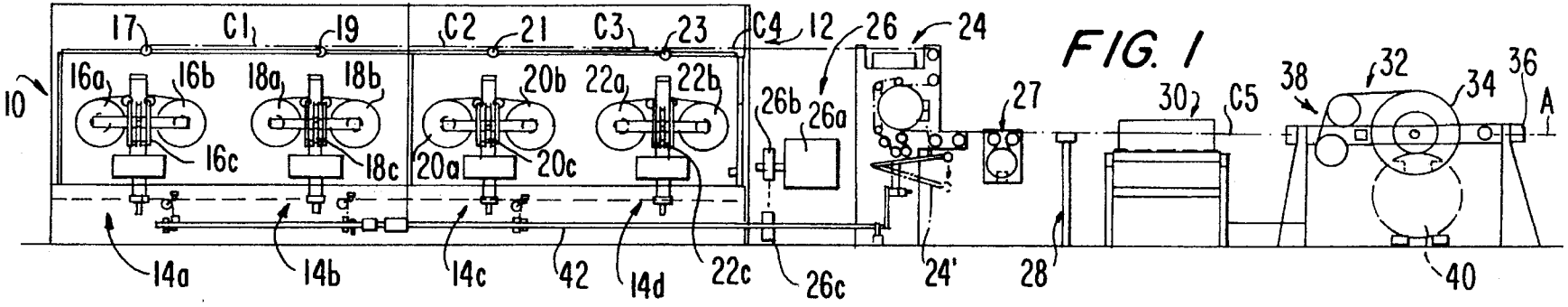
FIG. 1 is a diagrammatic front elevational view a machine line for producing twisted pair cables in accordance with the present invention.

Referring now specifically to the drawings, in which identical or similar parts are designated by the same reference numerals throughout, and first referring to FIG. 1, the apparatus for producing stable twisted pair cables for high frequency use in accordance with the present invention is in the form of a machine line generally designated by the reference numeral 10.

The machine 10 has an upstream end, on the left side of the machine as viewed in FIG. 1, where production of the cable commences and a downstream end, on the right side of the machine as viewed in FIG. 1, where the assembled or composite cable is taken up onto a take-up reel. The machine 10 will be described in the order of its sequenced operations starting at the upstream end and moving towards the downstream end.

At the upstream end, there is provided a housing or frame 12 which houses a plurality of twisting heads 14*a*–14*d* which form a bank of twisting machines arranged in tandem along the longitudinal direction of the machine or line 10 as shown. Each of the heads 14*a*–14*d* is arranged to produce an n-wire twisted set. For purposes of the description of the preferred embodiments, each of the heads 14*a*–14*d* will be described as producing twisted wire pairs. However, as will be more fully discussed below, the apparatus and method can equally be used to produce numerous other twisted wire combinations forming simple as well as complex cable configurations.

The first twisting head 14*a* includes bobbins 16*a*, 16*b*, each of which is wound with a single conductor or wire element, for reasons which will be more fully discussed. The head 14*a* also includes a tape dispenser 16*c*. The twisting head 14*a* twists the two wire elements about each other and applies the tape about the twisted wire elements to form a first twisted and taped pair C1 which is deflected 90° by roller or pulley 17 to move along the longitudinal length direction of the machine 10 towards the downstream end of the machine.

Figure 1A:
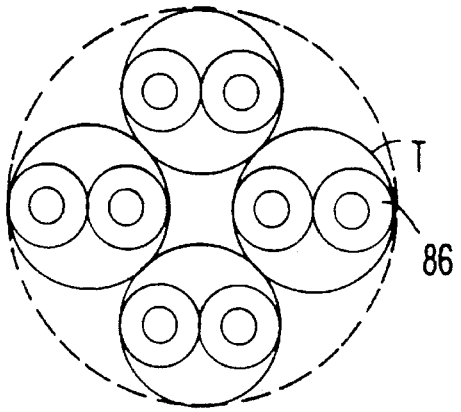
FIG. 1A is a cross-sectional view of the twisted and taped wire units or sets at CA in FIG. 1.

Similarly, the second twisting head 14*b* produces a similar twisted wire pair using wire elements or conductors from the bobbins 18*a* and 18*b* which are likewise twisted about each other and taped together with the tape from the dispenser 18*c*. A roller or pulley 19 deflects the second twisted wire pair 90° as shown so that it also now moves towards the downstream end of the machine 10 substantially co-extensively with the first twisted wire pair C1, so that two twisted and taped wired pairs appear at C2. Similar operations are performed by the twisting heads 14*c* and 14*d*. Thus, a third twisted and taped wire pair is produced by the twisting head 14*c* using the wire elements or conductors from the bobbins 20*a*, 20*b* and tape dispenser 20*c*, the resulting twisted and taped wire pair being deflected by the pulley or roller 21 to present three twisted and taped wire pairs at C3 which move together towards the downstream end substantially co-extensively with each other. Finally, the twisting head 14*d*, using the wire elements or conductors from the bobbins 22*a*, 22*b* and tape from the dispenser 22*c* produces a fourth twisted wire pair which, when deflected by roller or pulley 23, presents four twisted and taped wire pairs at C4 all generally parallel to each other and moving together towards the downstream end. FIG. 1A is a cross-section of the wire units or sets at C4.

As will be more fully described in connection with FIG. 3, the bobbins 16*a*, 16*b*, 18*a*, 18*b*, 20*a*, 20*b*, 22*a* and 22*b* are not themselves motorized. Accordingly, the four twisted and taped wire pairs at C4 are all simultaneously drawn downstream by a belt capstan 24 which is provided with a motive force, such as a motor drive 26. The specific capstan and motor drive used are not critical for the purposes of the present invention, and any conventional or suitable components of this type appropriate for the specific application may be used. In this connection, it may also be pointed out that the bobbins supported in each of the twisting heads may themselves be motorized under certain circumstances, particularly where the wire elements or conductors are themselves relatively fragile and susceptible to excessive elongation or where friction plays an important factor in the overall forces or stresses developed in the individual conductors.

An optional measuring unit 27 is provided downstream from the belt capstan 24 to provide a continuing indication of the linear speed of movement of the cable being produced by the twisting machines or heads. Here, a dancer 24' monitors the tension in the sets C4 and controls the take-up speed of the composite cable at the downstream end of the line.

The four individual twisted and taped wire pairs are passed through a closing die 28. Station 30, downstream from the closing die 28 represents a pre-twister for pre-twisting the multiple wire sets in conjunction with the application of a tape to bind the multiple wire sets just prior to take-up on a rotating take-up to produce a cable with a continuous spiral or twist along the length of the cable. Where wire specifications permit, it is also possible to periodically alternate the lays of the multiple wire sets, in which case the unit 30 may represent an oscillator unit, the output of which can feed a composite cable into an extruder, a cooling unit and a stationary take-up. However, the station 30 may be omitted, in which case the continuously twisted sets form a composite cable taken up on the rotation take-up 32. Subsequently, such twisted cable can be inputted to an extruder to fix the sets within the cable.

The last component or element shown at the downstream end of the machine 10 is a common take-up 32 which includes a take-up reel or bobbin 34 supported on a rotating cradle 36 which rotates about the axis A of the machine 10. A polar traverse 38 is preferably provided for distributing the wire uniformly between the flanges of the bobbin 34. A suitable drive is used to rotate the bobbin 34 about the axis A so as to provide a twist to the composite cable C5 which enters the common take-up 32. The reference numeral 40 represents the position of the bobbin 34 in the loading/unloading positions before it is lifted to the cradle supported position.

Each of the twisting heads 14*a*–14*d* is driven so that at least one rotating element thereon, to be more fully discussed below, is rotated to provide the necessary twists to the individual conductors or wire elements and the tapes. In FIG. 1, there is illustrated a drive shaft 42 which is coupled to the drive 26, which also drives the belt capstan 24. The drive 26 includes a motor 26*a*, a motor pulley 26*b*, a driven pulley 26*c* and a belt 26*d* engaging the two pulleys. The drive shaft 42 extends upstream along the longitudinal direction of the machine 10 so as to be proximate to each of the twisting heads 14*a*–14*d*. Any suitable or conventional transmission arrangements can be used to transmit power from the drive shaft 42 to the rotating elements of the rotating heads 14*a*–14*d*.

Figure 2:
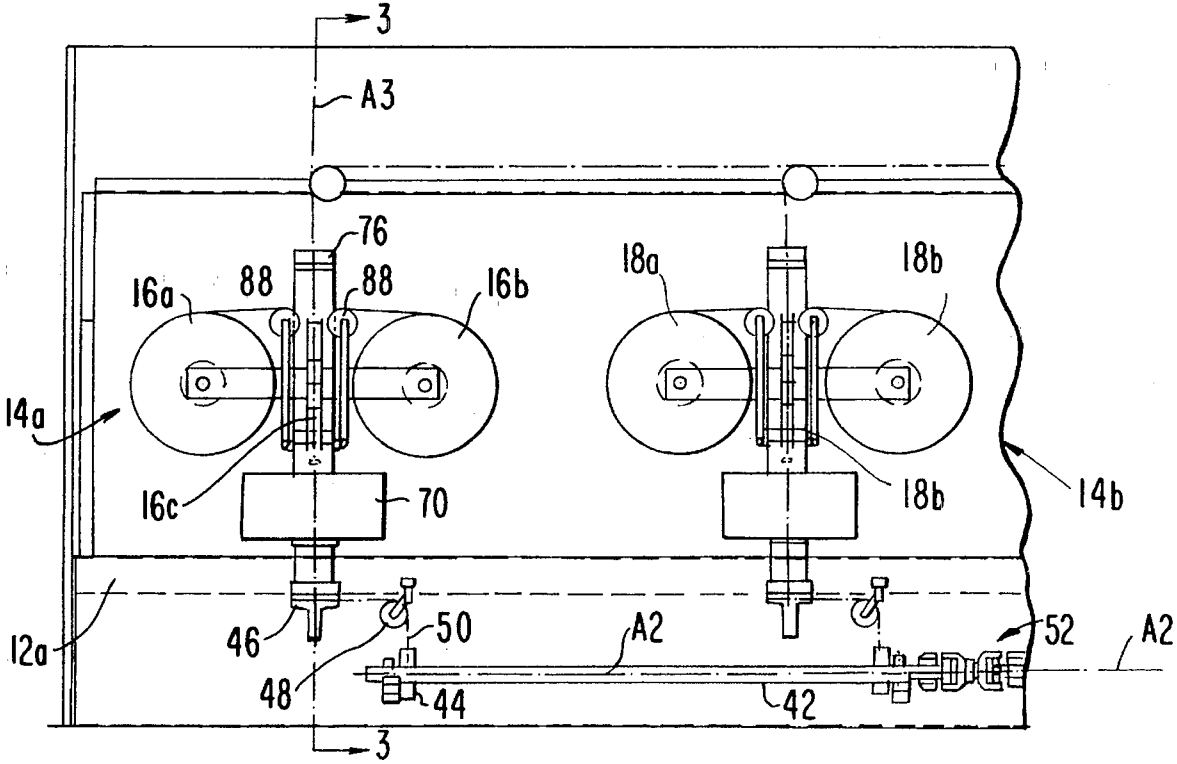
FIG. 2 is an enlarged front elevational view of the machine line shown in FIG. 1, illustrating in more detail the first two double twisting machines of the bank of such machines arranged in tandem for twisting multiple wires.

Referring to FIG. 2, the specific transmission used in the described embodiment is more fully illustrated. Thus, the shaft 42 is mounted in suitable bearings to rotate about a shaft axis A2. Mounted proximate to each of the twisting heads there is provided a transmission for transferring power and rotation to the twisting head. Since all of the transmissions in connection with each of the four twisting heads 14*a*–14*c* are the same, only the one transmission in connection with the twisting head 14*a* will be described. A belt pulley or sheave 44 is mounted on the drive shaft 42 for rotation about axis A2. As will be more evident from FIG. 3, the twisting head 14*a* includes rotating elements which rotate about a vertical shaft about axis A3 which is substantially normal to the axis A2. A vertical rotating shaft of the twisting head 14*a* is fixed to a belt pulley or sheave 46 which is mounted for rotation about the vertical axis A3. A pair of deflecting pulleys, sheaves or rollers 48 is mounted on the stand or support structure 12*a* of housing 12 for deflecting by 90° the direction of a flat belt 50 which is coupled to the pulleys or sheaves 44, 46. Two deflecting pulleys or sheaves 48 need to be provided, as best shown in FIG. 3, for deflecting both portions of the belt which proceed towards the pulley 46 and return from the pulley 46. It will be appreciated that the arrangement described provides an inexpensive and efficient method of driving each of the twisting heads. Other mechanical transmissions or individual motors for each head may be used, however, in order to drive the rotating elements of the twisting heads. In this connection, the drive shaft 42 may itself be formed of two or more sections of drive shaft coupled to each other by any suitable means, such as a universal coupling 52 to transmit power to a plurality of twisting heads without the need to provide for a costly installation which is highly sensitive to the critical positioning of the various coupled mechanical elements. This is particularly useful when the machine 10 includes a large number of twisting heads all of which are driven by a single drive shaft.

In selecting power transmissions for rotating the twisting heads 14*a*–14*d*, provisions must be made for adjusting the gearing ratios so that for a given rotational speed of the drive shaft 42, each of the twisting heads 14*a*–14*d* can be rotated at slightly different speeds. This is particularly important in connection with high frequency communication cables in which cross-talk is to be minimized or eliminated. To do this, it is important to modify the lay lengths of the twisted wire pairs, triads or quads so that the individual conductors in a given twisted set avoids being parallel to another wire or conductor in another twisted set. By changing the lay lengths of adjacent twisted sets, inter-wire coupling between different twisted sets and cross-talk is minimized. In the preferred embodiment, referring to FIG. 2, the adjustability of the lay for each individual twisting head can be adjusted by selecting the relative diameters of the pulleys 44 and 46, the ratio of the diameters of those two pulleys determining to what degree the twisting heads will rotate faster or slower than the rotational speed of the drive shaft 42. Typically, traditional lay lengths for twisted wire sets which have not been taped in accordance with the present invention will vary within the range of 0.5–0.75 inches.

Figure 3A:
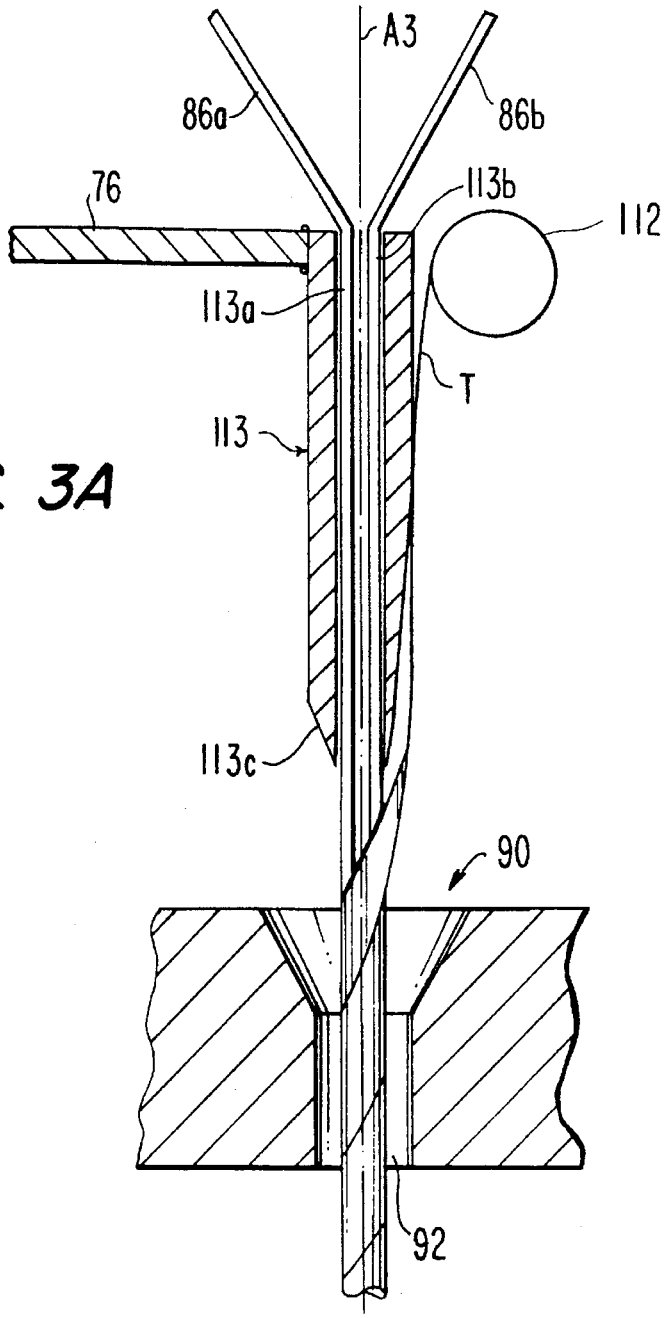
FIG. 3A is an enlarged view of the machine shown in FIG. 3 illustrating the details of the wire elements or conductors converging, being twisted and taped.
Figure 3:
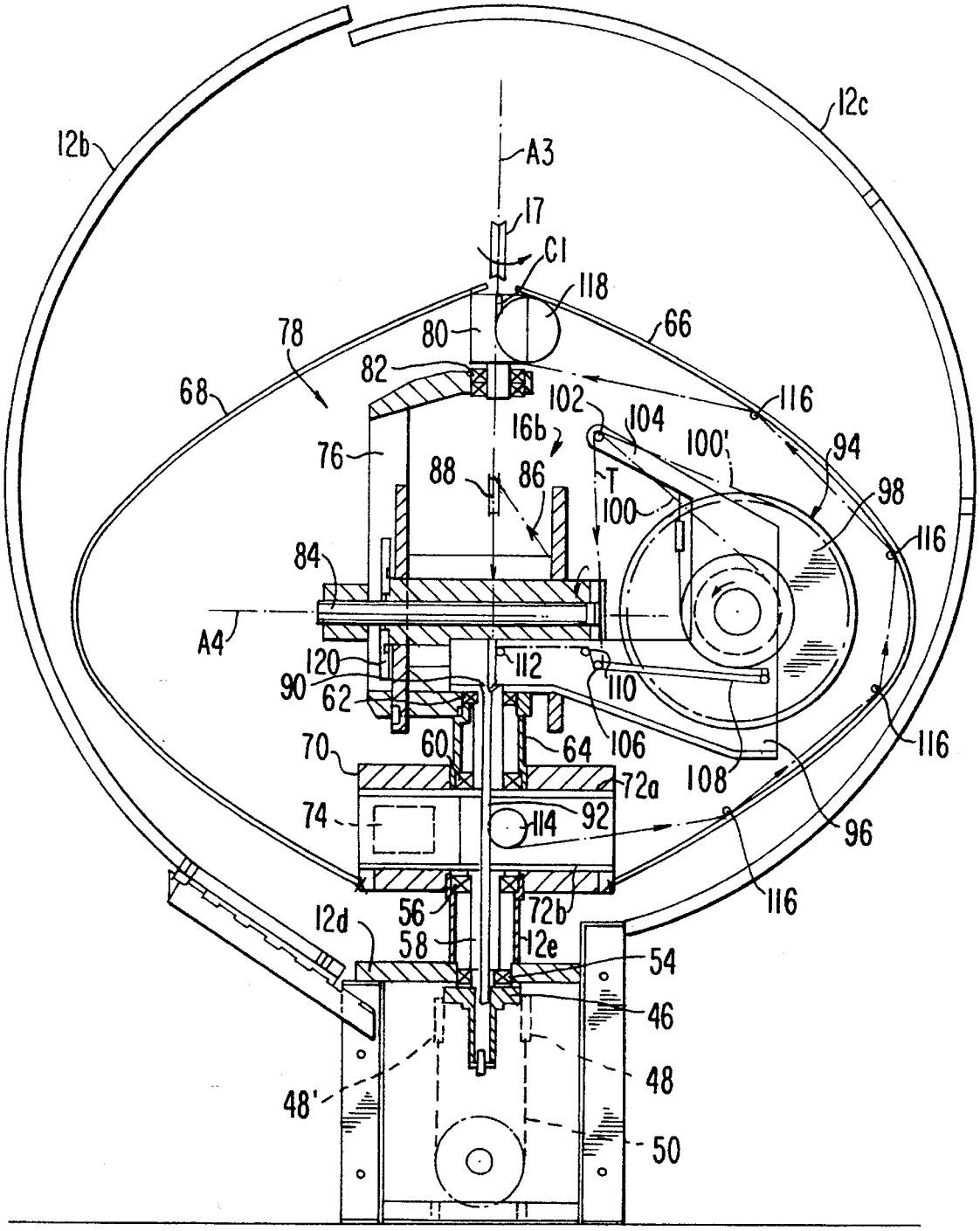
FIG. 3 is an enlarged cross-sectional view of the first double twist machine shown in FIG. 2, taken along line 3—3.
Figure 4:
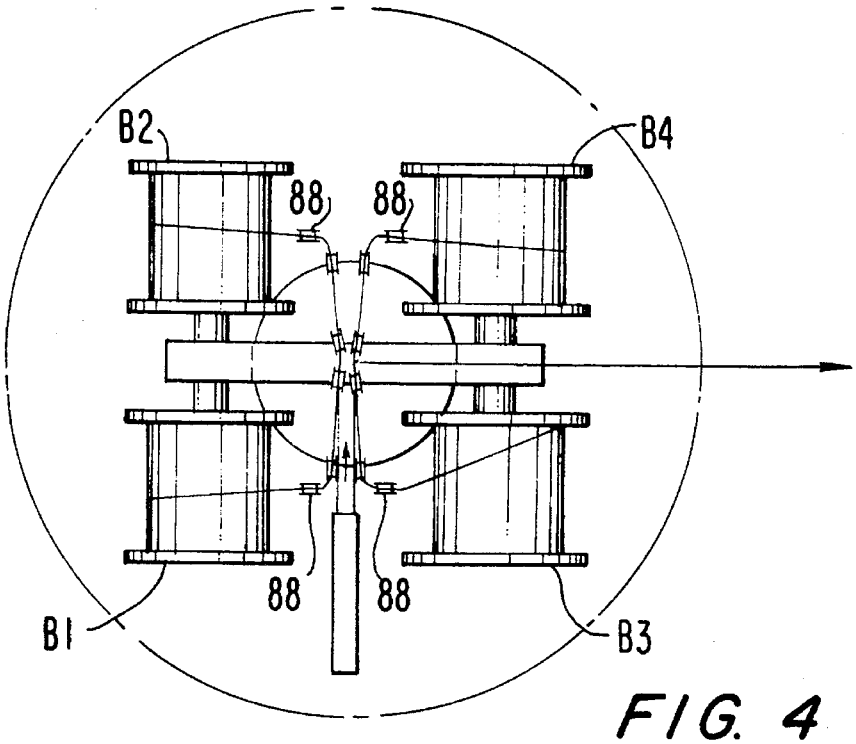
FIG. 4 is a top plan view of a modified twisting head arranged to accommodate four separate reels or bobbins and a tape dispenser.

Turning to FIG. 3, details of a twisting head 14*a* is illustrated in greater detail. Generally, the twisting head is shown mounted for rotation about vertical axis A3 on a stand or support structure 12*a* which forms a part of the housing 12. Because of the high speed of rotation of the rotating elements forming part of the twisting heads, the twisting heads are normally and advantageously fully enclosed so as to prevent injury to personnel. Such enclosures are well-known and include a fixed cylindrical section 12*b* at the rear of the machine, as normally viewed by an operator standing on the right side of the unit as viewed in FIG. 3. A second, pivotally mounted section 12*c* serves as a guard and can be moved so as to expose the twisting heads for replacement of empty bobbins or tape pads as well as for servicing the unit.

The individual twisting heads 14*a*–14*d* are constructed very similarly to twisting heads described in U.S. patent application Ser. No. 08/163,735, assigned to the assignee of the instant application. Reference is made to the aforementioned application, therefore, for at least some of the details of construction which will not be repeated here for the sake of clarity and brevity. The discussion that follows will primarily focus on the details of construction of the twisting heads which bear more fully on the aspects of the present invention for the manufacture of uniform impedance communication cables.

The stand or support structure 12*a* includes a horizontal table or support surface 12*d* on which there is fixedly mounted a vertical cylindrical support structure 12*e* as shown. Bearings 54, 56 are secured in the cylindrical support structure 12*e* as shown, these bearings rotatably supporting a rotating shaft 58 which is substantially of uniform external diameter with the exception of the central region thereof, which is enlarged, as shown, for reasons to be described. The upper end of the shaft 58 is similarly supported by bearings 60, 62 which are housed within a vertical cylindrical structure 64 as shown.

The shaft 58 is connected or coupled to rotating bows 66, 68 which are diametrically opposed and connected at the lower ends thereof to a rotating drum 70 which is itself connected to the vertical shaft 58 in any appropriate manner. In the preferred embodiment, such rotating drum 70 is coupled to the vertical shaft 58 by means of horizontal webs, spokes, or walls 72*a*, 72*b*. For reasons which will be evident to those skilled in the art, and as well fully discussed in the applicant's earlier application Ser. No. 08/163,735, there is provided means 74 (shown schematically in dashed outline) for fixing the position of a reel cradle 76 against rotation about the axis A3 of the twisting head 14*a*. In this way, while the bows 66, 68 can be rotated at extremely high speeds, the elements now to be described, positioned within an envelope 78 defined by the rotating bows 66, 68, remain stationary in relation to the axis A3. One example of such cradle fixing means 74 is an epicyclic transmission which is coupled to the vertical cylindrical support members 12*e* and 64. In this manner, the vertical cylindrical support member 64, which supports the cradle 76 itself becomes stationary in relation to the axis A3 as is the cylindrical support member 12*e*.

The bows are arranged in a substantially balanced configuration for rotation about the axis A3 relative to the frame 12. While the specific size or configuration of the bows 66, 68 is not critical, it will be evident that the dimensions as well as the shape of the bows 66, 68 should be selected to provide a sufficiently large envelope 78 to accommodate the various components or elements now to be described. For this reason, the transverse dimension along the horizontal direction between opposing peaks of the bows is shown to be greater than the spacing between the vertical ends of the bows along the axis A3. Such configuration of the bows accommodates an arrangements of bobbins and tape dispenser as shown in FIGS. 1 and 2 wherein all of these components are mounted for rotation about axes substantially in a common horizontal plane. The configuration of the bows may need to be modified significantly if the bobbins and tape dispenser are mounted for rotation about points which are offset from each other along the direction of the axis A3. The specific arrangements of the bobbins and tape dispenser is not critical for purposes of the present invention, and any such arrangement may be used as long as the bows 66, 68 are suitably configurated in order to generate an envelope 78 which will accommodate the internal components of such inside-out machines and not come into contact therewith.

The upper ends of the bows, as viewed in FIG. 3, are fixed to a rotating support member 80, the lower portion of which is supported in bearings 82 mounted on the upper arm or extent of the stationary reel cradle 76.

In the preferred embodiment being described, the reel cradle 76 supports two diametrically opposite reels or bobbins 16*a*, 16*b* which have been wound with one or more wire elements or conductors. As commonly understood in the art, a wire element or conductor is the metallic or conductive portion which is enclosed by an insulator coating or sheath. In FIG. 3, the bobbin 16*b* is rotatably mounted on spindle 84 which is mounted at one end thereof on the cradle 76. A wire element or conductor 86 is diagrammatically shown as being unwound from the rotating reel 16*b* about axis of rotation A4 which is orthogonal to the axis A3 of rotation of the bows. The wire element or conductor 86 represents one or more wire elements or conductors, typically insulated, which may be separately wound on the bobbin 16*b* or two or more wire elements or conductors which are joined or connected to each other along their lengths and simultaneously payed off the bobbin as an integral elongate filament. A deflection pulley 88 mounted on dancer arm 88' (FIG. 2) redirects the wire element or conductor 86 towards the axis A3 and into an entry funnel 90 at the upper end of an axial bore 92 which extends through the shaft 58. A similar deflection pulley cooperates with the wire element or conductor drawn off the bobbin or spool 16*a*, so that both wire elements or conductors are directed into the bore 92 through the entry funnel 90.

The first take-off pulley 88 is advantageously mounted on an arm 88' of a dancer mechanism (not shown) which forms part of a constant tension and brake device which cooperates with a brake disk 120 coupled to the reel 16*b* to control the braking forces applied to the reel 16*b* during take-off of wire therefrom. Such a tension adjustment and brake mechanism is of the type disclosed in U.S. Pat. No. 4,423,588, wherein it is more fully described.

An important feature of the present invention is the provision of a tape dispenser generally indicated by the reference numeral 94 arranged within the envelope 78 for dispensing a suitable tape T. The tape dispenser 94 includes a support bracket 96 which is mounted on the cradle 76 and/or the vertical cylindrical support 64 to also render the bracket 96 stationary in relation to rotation about the axis A3. A tape pad 98 is mounted for rotation about an axis generally transverse to the axis A3. Preferably a traverse wound tape pad is used in which the overall tape length generally corresponds to the lengths of the wire elements or conductors wound on the bobbins or reels to minimize The tape T is diagrammatically illustrated in FIG. 3 as being drawn off the tape pad 98, the reference numeral 100 indicating the orientation of the tape being drawn off when the tape pad is almost depleted, while the reference numeral 100' indicating the path of the tape when the tape pad is full. In both cases, the tape T is guided about a roller 102 mounted on an upwardly projecting arm 104 as shown. The redirected tape T is directed downwardly as shown for engagement with a dancer roller 106 supported by an appropriate dancer 108 and thereafter redirected by rollers 110, 112 to a point along the axis A3 at which point the tape is redirected downwardly along the axis A3 and towards the entry funnel 90 together with the conductors or wire elements drawn off from the bobbins. Preferably, there is provided some means upstream of the entry funnel 90 (just above as viewed in FIG. 3) which assures that the tape T is smoothly and uniformly applied to the incoming wire elements or conductors 86*a*, 86*b*. Such means may be in the form of a tape former tube 113 fixedly mounted on the cradle 76 and having a bore 113*a* aligned with the axis A3. The upper end 113*b* of the tube 113 preferably extends to a position in proximity with the deflection roller 112 and is provided at the lower end with a tapered conical surface 113*c* the smallest diameter of which substantially corresponds to the diameter of the bore 113*a*. With such a tube 113, the tape T, which is flat when it leaves the deflection roller 112, is almost immediately brought into contact with the tube 113 to thereby prevent the tape T from buckling or folding upon itself. The tape T is moved downwardly and spirally about the tube 113 until it leaves the tapered conical surface 113*c* and is evenly applied to the wire elements or conductors as they exit the tube as shown. Such tape former tube 113 is commonly used to apply tape to avoid curling or folding of the tape.

The wires and tape T are then directed towards a deflection pulley 114 which is mounted on the enlarged midsection of the rotating shaft 58 so as to provide a twist to the wire elements or conductors and twisting the tape about such twisted conductors or wire elements to form a substantially integral construction in which the spatial integrity of the twisted wires are maintained relative to each other. The twisted and taped wire pair is then guided along the bow 66 in a conventional manner from the lower end of the bows, as viewed in FIG. 3, to the upper ends thereof by suitable guides 116, such as eyelets, rollers or pulleys which are conventionally used for this purpose. Once the twisted and taped wire pair reaches the upper end of the bows, another twist is imparted by means of an upper deviation pulley 118 which is rotatably mounted on rotating support member 80. The redirected twisted and taped wire pair just past the upper deviation pulley 118 is represented by the designation C1 which is again deflected or redirected by deflection pulley 17 mounted on the housing or frame 12 as previously indicated.

The specific tape T used is not critical and all tapes currently used for taping conductors may be used, as long as the tape is sufficiently elastic to avoid breakage and excessive stresses and deformations of the conductor insulations. Since the tape only serves as a mechanical binder, a wide variety of tapes may be used, such as polyethylene tapes sold as "Mylar." Other plastic and other foil tapes may be used.

Figure 5:
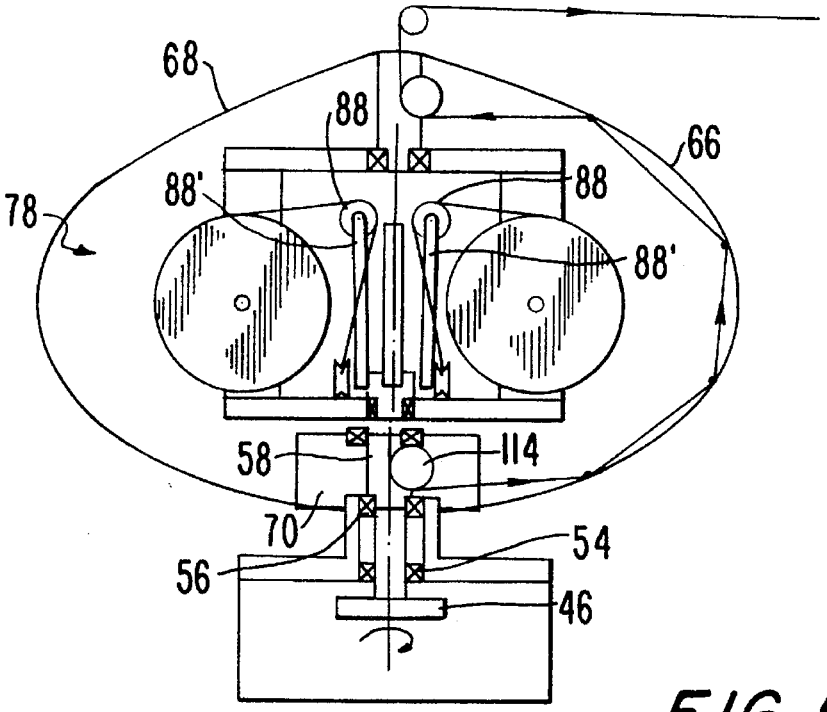
FIG. 5 is a front elevational view of the modified twisting head shown in FIG. 4.

The machine 10 can be used to provide uniform impedance communication cables for high frequency use in numerous configurations and levels of complexity. As suggested above, the presently preferred embodiment has been described in connection with the formation of a composite cable consisting of four twisted and taped wire pairs. Each wire pair is produced on a separate twisting head 14*a*–14*d*, each twisting head having been described as supporting two separate bobbins each of which supplies a single wire element or conductor. However, in its broadest aspects, numerous modifications may be made both to the configuration of the machine as well as in its application. Thus, although a double twist arrangement has been shown in connection with each twisting heads 14*a*–14*d*, it will be clear that single twist machines can also be used at each of the twisting stations or in combination with double twisting machines. The extent of twisting, in that event, will, of course, be different and the productivity of the overall machine may be somewhat compromised because of the lower operational speeds of single twist machines. Furthermore, while the bank or arrangement of the twisting machines has been described as including four twisting heads, it should be clear that a single twisting head may be utilized for the production of the simplest twisted wire pair conductors or numerous twisting units may be used, one for each twisted wire configuration to be included in a composite cable. Furthermore, as suggested, in the production of the simplest twisted pairs, each of the bobbins may issue a single wire element or conductor. However, other numerous approaches can be taken. It is only important, in fact, that the cradle 76 be dimensioned to receive as few as a single reel wound with a total of at least two separate or connected wires which are simultaneously unwound therefrom. Thus, it is possible to include but a single reel on which there have been wound two separate wire elements or conductors which are simultaneously unwound. However, it is possible to use integrally formed insulated wire elements or conductors which have been joined along their lengths, such as by connecting webs between the respective insulations or by joining the insulations directly to each other as by fusion or adhesive. Numerous combinations or permutations can clearly be envisioned. Thus, if a twisted wire triad is to be formed, this can be achieved with either three bobbins each issuing one single wire element or conductor, two reels one of which issues a single wire element or conductor and the other issues two separate or connected wire elements or conductors, or even a single reel which issues three wire separate or connected elements or conductors. The formation of a twisted wire quad can likewise be formed in a number of different ways, such as two separate or connected wires issuing from each of two reels, two reels one of which issues a single wire element or conductor and the other issues three separate or connected wire elements or conductors, or four reels each issuing a single conductor. The latter configuration is, indeed, illustrated in FIGS. 5 and 6, in which two bobbins are each mounted on a common shaft and each bobbin issues a single wire element or conductor, in which case the four wire elements or conductors together with the tape are guided towards the axis of the twisting head, and in particular, the axis of the rotation of the bows so that the four wire elements or conductors are twisted about each other and simultaneously taped to fix or maintain the spatial integrity of all of the twisted wires relative to each other. Such a twisted wire quad can, in turn, be combined with other twisted wire configurations to form a more complex composite cable. The drawing off of a plurality of wire elements or conductors from a single bobbin and twisting such wires about each other, although without the taping of these wires, is disclosed in the aforementioned U.S. patent application Ser. No. 08/163,735.

It will be appreciated, therefore, that the method of producing uniform impedance communication cables for high frequency use comprises the steps of simultaneously unwinding a total of at least two wires from as few as a single reel. Tape is dispensed and guided along with the wires to a twisting station at which the wires are twisted about each other with a predetermined lay and the tape is wound about the twisted wires to fix or maintain the spatial integrity of the twisted wires relative to each other. In this manner, the desired electrical properties of the twisted wires are assured and maintained constant. The individually twisted and taped wire sets, exhibiting different lay lengths, can then be combined and further twisted about each other to form a composite cable. As indicated above, such twisting of the wires about each other can be performed by imparting a single twist or a double twist to such wires and tape. This method can be used to produce high quality uniform impedance communication cables for high frequency use made up of a plurality of n-wire twisted sets, where n can be equal to 2, 3, 4 or any other desired number as practiced within the trade.

In the embodiment illustrated in FIG. 1, the twisted and taped wire pairs at C4 are taped together to bind the multiple wire sets just prior to take up to form a composite cable with a continuous spiral or twist along the length of the cable. As previously indicated, however, the unit 30 may be replaced with an oscillator unit to periodically alternate the lays of the multiple wire sets, and the output can be fed to an extruder unit. Such an arrangement is illustrated in FIGS. 6 and 7.

Figure 6:
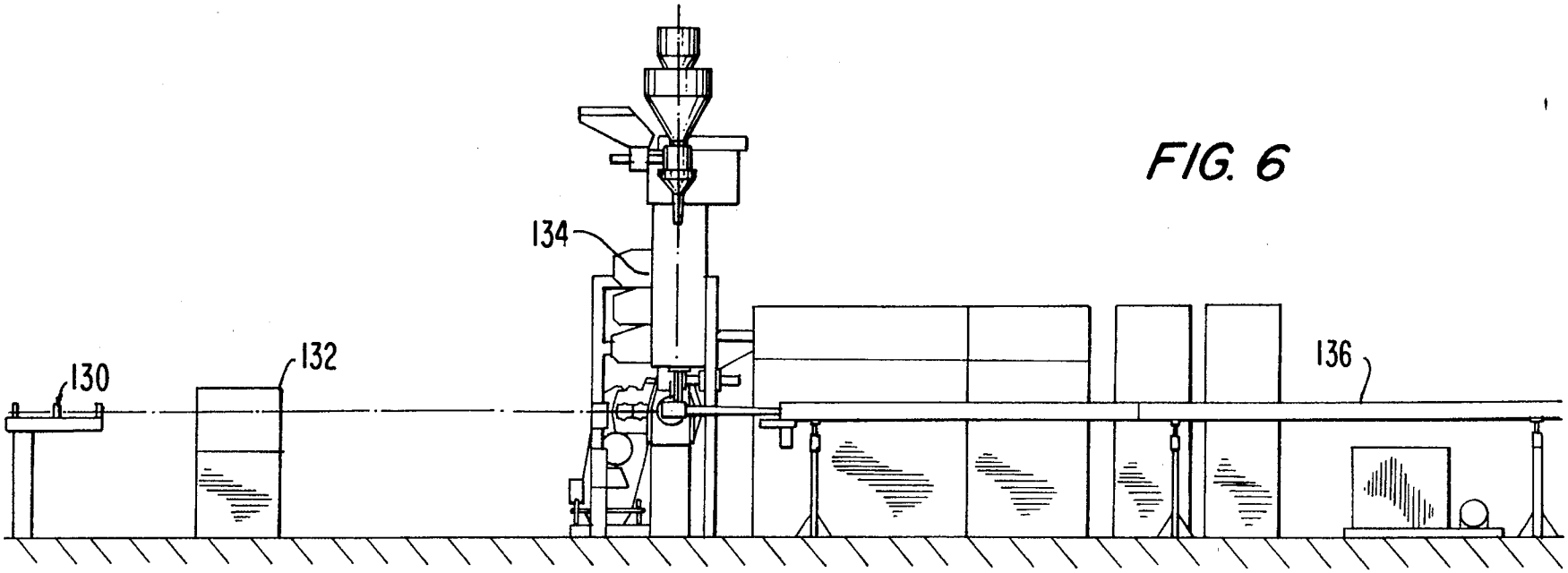
FIG. 6 is a side elevational view of a section of a modified embodiment of an assembling means of the machine shown in FIG. 1, in which the taping operations of the wire elements or conductors to form a composite cable are replaced by extruding operations.
Figure 7:
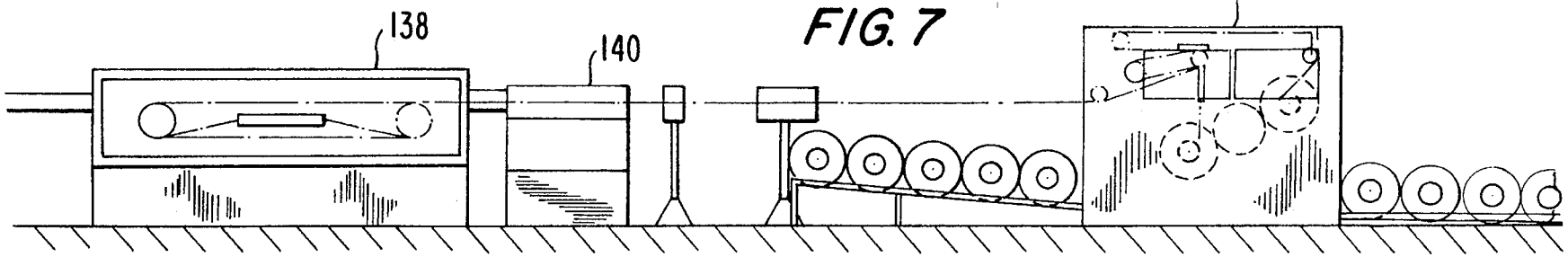
FIG. 7 is a side elevational view of the back end or downstream end of the machine shown in FIG. 6, showing extrusion-related operations and take-up of the composite cable.

FIGS. 6 and 7 illustrate the intermediate and downstream ends of a modified line which replace a number of elements or components shown in FIG. 1 downstream of the belt capstan 24. Thus, in FIGS. 6 and 7, the oscillator 130 periodically reverses the lays of the multiple wire sets C4 and imparts sufficient twists of the individual wire pairs to provide adequate stability to the twisted pairs to at least temporarily maintain the physical integrity of the composite cable until the composite cable is passed through an extruder. However, an optional binder unit 132 may be provided just downstream of the oscillator 130 to apply any well known binder material to the composite cable to enhance its stability and retain the wire sets in their desired relative positions or orientations. Downstream from the oscillator 130, and the binder application unit 132, if one is used, there is provided conventional extruder 134 in which an external protective sleeve or sheath (FIG. 1A) is applied to fix the relative positions and orientations of the wire pairs. The composite cable can now be processed in accordance with well-known techniques, including passing the extruded composite cable through a cooling unit 136, a capstan and cooling box 138, and a vacuum wiper 140 from which the composite cable can be taken up on dual take-ups 142. It will be appreciated, therefore, that the formation of the wire pairs in both embodiments is the same. The only difference between the two embodiments is the manner in which the individual wire pairs are permanently secured to each other to form a composite cable. In the embodiment of FIG. 1, a tape is externally applied to the plurality of wire pairs, while in FIG. 6 a sheath or sleeve is extruded exteriorally of the wire pairs. In both cases, a mechanical method is used to secure the wire pairs to each other in fixed relative positions to each other.

Since the characteristic impedance of an n-wire twisted line of individual wire elements is a function of the diameters of the individual conductors, the spacing therebetween and the electrical properties of the material occupying the space between the conductors (e.g. air or insulation), it is important in the production of such uniform impedance communication cables suitable for high frequency use that when twisting insulated conductors about each other, the diameters of the wire elements as well as the diameters of the insulation be selected and maintained within close tolerances so as to avoid any meaningful deviations in those geometrical parameters. Additionally, eccentricity of the electrical wire conductors as positioned within the electric insulation should be minimized, typically less than 90%. Once the eccentricity as well as the geometrical dimensions of the insulated conductors can be closely monitored, it is also desirable that the application of the tape about the twisted conductors be at a substantially uniform pressure so as not to produce different levels of deformation of the insulating layers since this would, in effect, modify the spatial relationships and spacings between the conductors. Changes in the compression or deformation of the insulating layers would, accordingly, change the characteristic impedance along the length of the conductors and this would produce unpredictable and undesirable changes in electrical characteristics or properties which, particularly at higher data transmission rates and higher frequencies, could adversely affect the impedance of the cable, power transfer and upper frequency limits at which the cable is useful.

Twisted wire lines of the type above discussed are becoming increasingly important as efforts are made to increase rates of data transfer in connection with computer networks, sophisticated telephone services and broadcast of audio and video programming. In order to meet this demand, the cables made in accordance with the present invention provide predictable and stable electrical characteristics at frequencies in excess of 300 mHz, significantly higher than the frequency range of cables that are currently used and classified as Level 5 by EIA/TIA standards. By physically securing the twisted conductors to each other, by taping, and, in effect, locking them to each other, their spatial relationship becomes fixed, notwithstanding any bending of the resulting cable. Such fixing of the spatial relationship sets and maintains the characteristic impedance of the cable at a desired level which minimizes return losses, and impedance imbalances. As a result of such more even impedance, significant improvements in signal integrity can be achieved. Such control of conductor-to-conductor spacing and tension, which achieves more predictable and uniform impedance along the length of the conductors is achieved with a technique which allows for high production rates and minimum construction costs. With this invention one can achieve the same desirable electrical characteristics with larger lay lengths thereby increasing productivity of the cable without compromising its electrical properties.

The invention has been shown and described by way of a presently preferred embodiment, and many variations and modifications may be made therein without departing from the spirit of the invention. The invention, therefore, is not to be limited to any specified form or embodiment, except insofar as such limitations are expressly said forth in the claims.

I claim:

1. Apparatus for the manufacture of uniform impedance communication cables for high frequency use comprising a frame; rotating means arranged in a substantial balanced configuration for rotation about an axis relative to said frame, said rotating means including a rotating element offset from said axis which defines an envelope as said rotating element rotates about said axis; a cradle dimensioned to receive as few as a single reel mounted within said cradle, said as few as a single reel being wound with a total of at least two wires which are simultaneously unwound from said as few as a single reel; cradle fixing means for maintaining the position of said cradle substantially fixed about said axis relative to said frame during rotation of said rotating means; tape dispensing means arranged within said envelope for dispensing tape; and guide means for guiding said at least two wires and tape to said rotating means for twisting the wires about each other with a predetermined lay and winding the tape about the twisted wires to fix and maintain the spatial integrity of the twisted wires relative to each other, wherein a plurality of like apparatus are provided each including said rotating means; and further comprising take up means for receiving and winding a plurality of sets of double twisted wires generated by each of said apparatus, assembling means for assembling said plurality of sets of double twisted wires, said assembling means comprising means for applying tape about said plurality of sets of double twisted wires to form a composite cable, whereby desired electrical properties of the twisted wires is assured.

2. Apparatus for the manufacture of uniform impedance communication cables for high frequency use comprising a frame; rotating means arranged in a substantial balanced configuration for rotation about an axis relative to said frame, said rotating means including a rotating element offset from said axis which defines an envelope as said rotating element rotates about said axis; a cradle dimensioned to receive as few as a single reel mounted within said cradle, said as few as a single reel being wound with a total of at least two wires which are simultaneously unwound from said as few as a single reel; cradle fixing means for maintaining the position of said cradle substantially fixed about said axis relative to said frame during rotation of said rotating means; tape dispensing means arranged within said envelope for dispensing tape; and guide means for guiding said at least two wires and tape to said rotating means for twisting the wires about each other with a predetermined lay and winding the tape about the twisted wires to fix and maintain the spatial integrity of the twisted wires relative to each other, wherein a plurality of like apparatus are provided each including said rotating means; and further comprising take up means for receiving and winding a plurality of sets of double twisted wires generated by each of said apparatus, assembling means for assembling said plurality of sets of double twisted wires, said assembling means comprising means for extruding a sheath about said plurality of sets of double twisted wires to form a composite cable, whereby desired electrical properties of the twisted wires is assured.

* * * * *